US009914011B2

(12) United States Patent
Downey et al.

(10) Patent No.: US 9,914,011 B2
(45) Date of Patent: Mar. 13, 2018

(54) IMPACT DAMPING MAT, EQUIPMENT ACCESSORY AND FLOORING SYSTEM

(71) Applicant: Pliteq Inc., Toronto (CA)

(72) Inventors: Paul Downey, Toronto (CA); Paul Gartenburg, Toronto (CA)

(73) Assignee: Pliteq Inc. (CA)

( * ) Notice: Subject to any disclaimer, the term of this patent is extended or adjusted under 35 U.S.C. 154(b) by 0 days.

(21) Appl. No.: 14/954,185

(22) Filed: Nov. 30, 2015

(65) Prior Publication Data

US 2016/0375296 A1 Dec. 29, 2016

Related U.S. Application Data

(60) Provisional application No. 62/184,352, filed on Jun. 25, 2015.

(51) Int. Cl.

| | |
|---|---|
| ***A63B 21/00*** | (2006.01) |
| ***E04F 15/10*** | (2006.01) |
| ***E04F 15/22*** | (2006.01) |
| ***A63B 6/00*** | (2006.01) |
| ***A63C 19/04*** | (2006.01) |
| *A63B 21/072* | (2006.01) |

(52) U.S. Cl.

CPC ..... *A63B 21/4037* (2015.10); *A63B 6/00* (2013.01); *A63C 19/04* (2013.01); *E04F 15/107* (2013.01); *E04F 15/225* (2013.01); *A63B 21/072* (2013.01); *E04F 2201/0138* (2013.01); *E04F 2201/022* (2013.01); *E04F 2290/044* (2013.01)

(58) Field of Classification Search

CPC .. H05K 7/20454; H05K 7/186; H05K 7/1495; F16M 9/00; F16M 7/00; F16F 7/087; F16F 7/082; F16F 7/085; F16F 7/12; F16F 7/01; F16F 15/04; E04F 15/20; E04F 15/203; E04F 15/206; E04F 15/185; E04F 15/22; E04F 15/225; E04F 15/107; A63B 21/403

USPC ..... 267/140, 141, 153; 248/611, 634, 632, 248/633, 637, 638, 639, 676, 678, 348.05, 248/346.05, 560; 52/167.1, 167.7, 167.8, 52/126.1, 126.5, 126.7, 126.6; 472/92

See application file for complete search history.

(56) References Cited

U.S. PATENT DOCUMENTS

| | | | |
|---|---|---|---|
| 205,271 | A | 6/1878 | Hyatt |
| 1,554,179 | A | 9/1925 | Trader |
| 1,940,105 | A | 12/1933 | Schmid |
| 2,001,916 | A | 5/1935 | Mazer |
| 2,077,617 | A | 4/1937 | Cramer |

(Continued)

FOREIGN PATENT DOCUMENTS

| | | | |
|---|---|---|---|
| DE | 3407031 | A1 | 9/1985 |
| DE | 4141023 | A1 | 6/1993 |

(Continued)

*Primary Examiner* — Babajide A Demuren

(74) *Attorney, Agent, or Firm* — Tarolli, Sundheim, Covell & Tummino LLP

(57) ABSTRACT

An impact damping mat comprises a base layer having a base surface with a plurality of protuberances, a damping layer overlying the base layer, a load distribution layer overlying the damping layer and an upper layer overlying the load distribution layer and having a planar top surface. The materials and dimensions of the layers cooperate to provide a selected rebound characteristic and a selected sound reduction characteristic.

30 Claims, 7 Drawing Sheets

(56) References Cited

U.S. PATENT DOCUMENTS 2,270,902 A 1/1942 Rubissow
2,288,054 A 6/1942 Walton
2,290,622 A 7/1942 Carter
2,337,525 A 12/1943 Peik
2,665,848 A 1/1954 Smith et al.
2,768,091 A 10/1956 Cubberley
2,821,254 A 1/1958 Kernen
2,862,255 A 12/1958 Nelson
2,940,887 A 6/1960 Daly et al.
2,961,029 A 11/1960 Rainar
3,026,224 A 3/1962 Rogers, Jr.
3,160,549 A 12/1964 Caldwell et al.
3,311,331 A 3/1967 Steimen
3,345,245 A 10/1967 Hanusa
3,399,103 A 8/1968 Salyer et al.
3,418,812 A 12/1968 Khan et al.
3,436,042 A * 4/1969 Van Goubergen ..... F16F 1/376 248/633
3,459,400 A * 8/1969 Rothermel ..... F16F 1/3737 248/636
3,567,563 A 3/1971 Haudenchild et al.
3,579,941 A 5/1971 Tibbals
3,641,855 A 2/1972 Balle
3,770,560 A 11/1973 Elder et al.
3,893,619 A 7/1975 Bruner
3,917,501 A 11/1975 Ferrucci et al.
3,924,907 A 12/1975 Czernik et al.
3,948,009 A 4/1976 Bernhard
3,985,198 A 10/1976 Kurtze et al.
4,002,315 A 1/1977 Van Goubergen
4,060,502 A 11/1977 Benton
4,112,176 A 9/1978 Bailey
4,143,495 A 3/1979 Hintz
4,179,067 A 12/1979 Baier
4,190,131 A 2/1980 Robinson
4,242,391 A 12/1980 Reinhardt et al.
4,244,841 A 1/1981 Frankland
4,265,398 A 5/1981 Luebke
4,361,614 A * 11/1982 Moffitt, Jr. ..... A47G 27/0212 156/250
4,428,454 A 1/1984 Capaul et al.
4,454,181 A * 6/1984 Hohn ..... E01C 5/226 428/156
4,457,120 A 7/1984 Takata
4,500,037 A 2/1985 Braitsch et al.
4,551,362 A 11/1985 Harms et al.
4,566,231 A 1/1986 Konsevich
4,637,942 A 1/1987 Tomarin
4,672,100 A 6/1987 Schonbachler et al.
4,681,786 A 7/1987 Brown
4,685,259 A 8/1987 Eberhart et al.
4,694,627 A 9/1987 Omholt
4,696,429 A 9/1987 Ortwein
4,720,043 A 1/1988 Ortwein
4,753,841 A 6/1988 Noel et al.
4,755,408 A 7/1988 Noel
4,771,944 A 9/1988 Brister et al.
4,803,112 A 2/1989 Kakimoto et al.
4,851,500 A 7/1989 Lalwani et al.
4,860,506 A 8/1989 Yoshimi et al.
4,888,927 A 12/1989 Yoshimi et al.
4,909,003 A * 3/1990 Hennigan ..... E04C 2/34 52/144
4,910,935 A 3/1990 Leukel et al.
4,917,932 A 4/1990 McClung
4,945,697 A 8/1990 Ott et al.
4,957,798 A 9/1990 Bogdany
4,967,529 A 11/1990 L'Heureux
4,973,505 A * 11/1990 Bielous ..... E01C 5/001 404/32
5,016,413 A 5/1991 Counihan
5,060,856 A 10/1991 Ortwein
5,096,772 A 3/1992 Snyder
5,110,660 A 5/1992 Wolf et al.
5,183,438 A 2/1993 Blom
5,187,905 A 2/1993 Pourtau et al.
5,258,222 A 11/1993 Crivelli
5,383,314 A 1/1995 Rothberg
5,424,099 A 6/1995 Stewart et al.
5,438,171 A 8/1995 Schmanski
5,439,735 A 8/1995 Jamison
5,472,750 A 12/1995 Miller
5,482,754 A 1/1996 Crook
5,487,501 A 1/1996 Engst et al.
5,527,409 A 6/1996 Lanphier
5,572,842 A 11/1996 Stief et al.
5,584,950 A 12/1996 Gaffigan
5,619,832 A 4/1997 Myrvold
5,653,099 A 8/1997 MacKenzie
5,714,219 A 2/1998 Mashunkashey et al.
5,721,035 A 2/1998 Dunn
5,738,279 A 4/1998 Ihle et al.
5,744,763 A 4/1998 Iwasa et al.
5,766,721 A 6/1998 Bussey, Jr. et al.
5,851,338 A 12/1998 Pushaw
5,853,352 A * 12/1998 Login ..... A63B 6/00 482/23
5,867,957 A 2/1999 Holtrop
5,873,936 A 2/1999 Ogden
5,879,781 A 3/1999 Mehta et al.
5,956,921 A 9/1999 Fleck et al.
6,077,613 A 6/2000 Gaffigan
6,182,413 B1 2/2001 Magnusson
6,212,838 B1 4/2001 Eda
6,213,252 B1 4/2001 Ducharme
6,224,707 B1 5/2001 Lion
6,235,367 B1 5/2001 Holmes et al.
6,251,493 B1 6/2001 Johnson et al.
6,256,955 B1 7/2001 Lolley et al.
6,291,048 B1 9/2001 Jerdee et al.
6,372,069 B1 4/2002 Walls
6,386,461 B1 5/2002 Wildgoose
6,427,925 B1 8/2002 Gaudet
6,468,631 B1 10/2002 Pahl et al.
6,481,637 B1 11/2002 McQueen
6,541,105 B1 4/2003 Park
6,595,321 B1 7/2003 Tompson
6,602,586 B2 8/2003 Kakimoto et al.
6,708,896 B2 3/2004 Robinson
6,723,413 B2 4/2004 Walters
6,769,834 B1 8/2004 Stange
6,786,852 B2 9/2004 Watterson et al.
6,796,096 B1 9/2004 Heath
6,918,215 B2 * 7/2005 Smith ..... E04F 17/00 52/177
6,920,723 B2 7/2005 Downey
6,945,007 B2 9/2005 Kobayashi et al.
6,990,703 B2 1/2006 Brown et al.
7,055,649 B2 6/2006 Tompson et al.
7,080,712 B2 7/2006 Tsuiki et al.
7,096,630 B1 8/2006 Keene et al.
7,166,678 B2 1/2007 Dunlap et al.
7,182,994 B1 2/2007 Scott
7,263,028 B2 8/2007 Thomas et al.
7,265,178 B2 9/2007 Maier et al.
7,278,588 B2 10/2007 English et al.
7,331,534 B2 2/2008 McQueen
7,464,791 B2 12/2008 Cooksey et al.
7,566,374 B2 7/2009 Brazier et al.
7,587,865 B2 * 9/2009 Moller, Jr. ..... E01C 5/20 52/177
7,730,684 B1 6/2010 Keene
7,730,685 B1 6/2010 Keene
RE41,945 E 11/2010 Downey
7,850,498 B2 * 12/2010 Yeh ..... B63B 35/7909 441/65
7,987,645 B2 * 8/2011 Tinianov ..... E04C 2/20 181/290
8,015,848 B2 * 9/2011 Colon ..... A47L 15/4257 68/3 R
8,113,495 B2 * 2/2012 Downey ..... F16F 1/37 248/633
2001/0052550 A1 12/2001 Janssens

(56) References Cited

U.S. PATENT DOCUMENTS

2002/0005250 A1 1/2002 Jerdee et al.
2002/0015840 A1 2/2002 Kakimoto et al.
2002/0040079 A1 4/2002 Lee et al.
2002/0074075 A1 6/2002 Brown et al.
2002/0088193 A1 7/2002 Reimers et al.
2002/0119716 A1 8/2002 Santhosh
2003/0033779 A1 2/2003 Downey
2003/0037508 A1 2/2003 Kobayashi et al.
2003/0040405 A1 2/2003 Watterson et al.
2003/0102184 A1 6/2003 Brisson et al.
2004/0050482 A1 3/2004 Abrams
2004/0055813 A1 3/2004 Tsuiki et al.
2004/0096645 A1 5/2004 Hancy et al.
2004/0123555 A1 7/2004 Cole
2004/0127614 A1 7/2004 Jiang et al.
2004/0202854 A1 10/2004 Esparza
2005/0023080 A1 2/2005 Tompson et al.
2005/0031829 A1 2/2005 Crenshaw et al.
2005/0032447 A1 2/2005 Tachibana et al.
2005/0037174 A1 2/2005 Streeton et al.
2005/0098648 A1 5/2005 McQueen
2005/0126848 A1 6/2005 Siavoshai et al.
2005/0221039 A1 10/2005 Dunlap et al.
2005/0282465 A1 12/2005 McNab
2006/0008612 A1 1/2006 Brazier et al.
2006/0016635 A1 1/2006 Downey
2006/0024453 A1 2/2006 Setser et al.
2006/0037815 A1 2/2006 Schabel, Jr.
2006/0072372 A1 4/2006 Thomas et al.
2006/0097064 A1 5/2006 English et al.
2006/0105136 A1 5/2006 Brazier et al.
2006/0151908 A1 7/2006 Brazier et al.
2006/0156663 A1 7/2006 Mao
2006/0162997 A1 7/2006 Cooksey et al.
2006/0165950 A1 7/2006 Dodge, III
2006/0167206 A1 7/2006 Maier et al.
2006/0189750 A1 8/2006 Maier et al.
2006/0191743 A1 8/2006 Pike, Sr. et al.
2006/0205869 A1 9/2006 Steidl et al.
2006/0230699 A1 10/2006 Keene
2007/0004306 A1 1/2007 Leeser et al.
2007/0172629 A1 7/2007 Dodge
2007/0261365 A1 11/2007 Keene
2008/0010930 A1 1/2008 Mao
2008/0081153 A1* 4/2008 Yeh ..... A01K 1/0157 428/156
2009/0283658 A1 11/2009 Keene
2010/0229486 A1 9/2010 Keene
2011/0107700 A1 5/2011 Keene
2012/0167522 A1* 7/2012 Pien ..... E04F 15/105 52/745.13
2013/0139464 A1* 6/2013 DeLong ..... E04B 5/00 52/588.1
2013/0180187 A1* 7/2013 Takeshita ..... E04B 1/98 52/167.8
2013/0312364 A1* 11/2013 Krovats ..... E04D 13/12 52/745.21
2014/0099847 A1* 4/2014 Tsai ..... B32B 5/26 442/1
2015/0059276 A1* 3/2015 Valentine ..... E04F 15/225 52/403.1
2015/0345154 A1* 12/2015 Permesang ..... E04F 15/08 428/304.4
2016/0053496 A1* 2/2016 Sosnowski ..... E04F 15/02038 52/588.1
2016/0251862 A1* 9/2016 Chen ..... B32B 27/06

FOREIGN PATENT DOCUMENTS

DE 19932991 A1 6/2000
DE 102013113538 * 6/2015 ..... B32B 7/12
EP 0916629 A1 5/1999
EP 0982444 A1 3/2000
EP 1447495 A1 8/2004
EP 1739253 A2 1/2007
EP 1757750 A1 2/2007
FR 2503206 A1 10/1982
FR 2824094 A1 10/2002
GB 841867 A 7/1960
GB 1120827 A 7/1968
GB 2379934 A 3/2003
GB 2428698 A 2/2007
GB 2437180 A 10/2007
JP 48014737 A 2/1973
JP 8297492 A 11/1996
JP 200054610 A 2/2000
WO 8302127 A1 6/1983
WO 8700828 A1 2/1987
WO 9312283 A1 6/1993
WO 9966144 A1 12/1999
WO 0155530 A1 8/2001
WO 0235025 A1 5/2002
WO 02094550 A1 11/2002
WO 2004031501 A1 4/2004
WO 2004058416 A1 7/2004
WO 2006131138 A1 12/2006
WO 2007015081 A1 2/2007
WO 2007082339 A1 7/2007

* cited by examiner

IMPACT DAMPING MAT, EQUIPMENT ACCESSORY AND FLOORING SYSTEM

CROSS REFERENCE TO RELATED APPLICATION

This application claims the benefit of U.S. Provisional Application No. 62/184,352 filed on Jun. 25, 2015, the entire contents of which are incorporated herein by reference.

FIELD

The subject application relates generally to impact damping, and more particularly to an impact damping mat, an equipment accessory and a flooring system for mitigating impact generated rebound, noise and/or vibration, for example, from high-impact fitness related activities.

BACKGROUND

Maintaining an active and healthy lifestyle is becoming increasingly important to people and engaging in a regular fitness routine may be part of that lifestyle. In some situations, these fitness routines may include high-impact training such as CrossFit or Olympic lifting where dropping weights on the floor is common. Weights dropped during these high-impact activities may rebound from the floor increasing the risk of injury to nearby persons and the risk of damage to surrounding structures and equipment. These high-impact activities may also generate significant vibrations, some of which may be audible as noise. These vibrations may propagate into and through surrounding structures creating undesirable noise and vibration pollution for nearby persons. Undesirable rebound and noise may also be generated by other high-impact activities unrelated to fitness, such as by moving equipment, by impacts from heavy objects or simply by high-traffic environments. Consequently, mitigating the rebound of objects and the noise they generate may be particularly desirable for locations where these high-impact activities take place, especially when these high-impact activities take place in gyms or other fitness, sports or training facilities located in buildings with other tenants.

Conventional noise mitigating mats and the like are often unsuitable for use with high-impact activities. For example, they may break down under the significant forces generated by the repetitive impacts, or insufficiently reduce rebound and vibrations. A durable and adaptable impact damping mat, equipment accessory and flooring system suitable for high-impact activities is desired.

It is therefore an object to provide a novel impact damping mat, a novel equipment accessory and a novel flooring system.

SUMMARY

Accordingly, in one aspect there is provided an impact damping mat comprising: a base layer having a base surface with a plurality of protuberances; a damping layer overlying the base layer; a load distribution layer overlying the damping layer; and an upper layer overlying the load distribution layer and having a planar top surface, wherein the materials and dimensions of the base layer, the damping layer, the load distribution layer and the upper layer cooperate to provide a selected rebound characteristic and a selected sound reduction characteristic.

According to another aspect there is provided an equipment accessory comprising: at least one impact damping zone, each impact damping zone including: a base layer having a base surface with a plurality of protuberances, a damping layer overlying the base layer, a load distribution layer overlying the damping layer, and an upper layer overlying the load distribution layer and having a planar top surface, wherein the materials and dimensions of the base layer, the damping layer, the load distribution layer and the upper layer cooperate to provide a selected rebound characteristic and a selected sound reduction characteristic; and at least one less damped zone adjacent to at least one of the impact damping zones, each less damped zone providing a different selected rebound characteristic and a different selected sound reduction characteristic than the adjacent impact damping zones.

According to another aspect there is provided a flooring system comprising: at least one impact damping zone, each impact damping zone including: a base layer having a base surface with a plurality of protuberances, a damping layer overlying the base layer, a load distribution layer overlying the damping layer, and an upper layer overlying the load distribution layer and having a planar top surface, wherein the materials and dimensions of the base layer, the damping layer, the load distribution layer and the upper layer cooperate to provide a selected rebound characteristic and a selected sound reduction characteristic.

According to another aspect there is provided an equipment accessory comprising: two impact damping zones, each impact damping zone comprising a base layer having a base surface with a plurality of protuberances, the base layer being formed of rubber and having a thickness of 11/16 of an inch, a damping layer overlying the base layer, the damping layer being formed of a polyether urethane material and having a thickness of ½ of an inch, a load distribution layer overlying the damping layer, the load distribution layer being formed of rubber and having a thickness of 5/16 of an inch, and an upper layer overlying the load distribution layer and having a planar top surface, the upper layer being formed of rubber, having a thickness of 1¼ inches and comprising a recessed undersurface from which a plurality of impact pedestals depend, wherein the impact pedestals contact the load distribution layer and space the undersurface from the load distribution layer, defining an interstitial void between the upper layer and the load distribution layer, wherein all of the layers are secured together with an adhesive, and wherein the base layer, the damping layer, the load distribution layer and the upper layer cooperate to provide a coefficient of restitution no greater than 30% and a reduction of a maximum sound level of at least 5 dB from 40 to 63 Hz ⅓ octave bands and at least 13 dB at and above 80 Hz ⅓ octave bands normalized to a conventional ⅜ inch rollout rubber flooring product; a less damped zone located adjacent and between the two impact damping zones, the less damped zone providing a different coefficient of restitution and a different reduction of the maximum sound level than each of the impact damping zones; and a frame at least partially surrounding the two impact damping zones and the less damped zone.

According to another aspect there is provided a flooring system comprising: a base layer having a base surface with a plurality of protuberances, the base layer being formed of rubber and having a thickness of 11/16 of an inch, the base layer comprising a plurality of elongate base layer runs placed contiguously in a first direction; a damping layer overlying the base layer, the damping layer being formed of a polyether urethane material and having a thickness of ½ of an inch, the damping layer comprising a plurality of elongate damping layer runs placed contiguously in a second direction perpendicular to the first direction; a load distribution layer overlying the damping layer, the load distribution layer being formed of rubber and having a thickness of 5/16 of an inch, the load distribution layer comprising a plurality of elongate load distribution layer runs placed contiguously in the first direction; and an upper layer overlying the load distribution layer and having a planar top surface, the upper layer being formed of rubber and having a thickness of 1¼ inches, the upper layer comprising a plurality of side-by-side tiles, each of the tiles comprising a recessed undersurface from which a plurality of impact pedestals depend, wherein, for each of the tiles, the impact pedestals contact the load distribution layer and space the undersurface from the load distribution layer, defining an interstitial void between the upper layer and the load distribution layer; wherein all of the layers are secured together with an adhesive; wherein the base layer, the damping layer, the load distribution layer and the upper layer cooperate to provide a coefficient of restitution no greater than 30% and a reduction of a maximum sound level of at least 5 dB from 40 to 63 Hz ⅓ octave bands and at least 13 dB at and above 80 Hz ⅓ octave bands normalized to a conventional ⅜ inch rollout rubber flooring product; and wherein each of the tiles comprises at least one interlocking feature to engage at least one adjacent tile in the plurality of side-by-side tiles.

BRIEF DESCRIPTION OF THE DRAWINGS

Embodiments will now be described more fully with reference to the accompanying drawings in which.

DETAILED DESCRIPTION OF EMBODIMENTS

Figure 1:
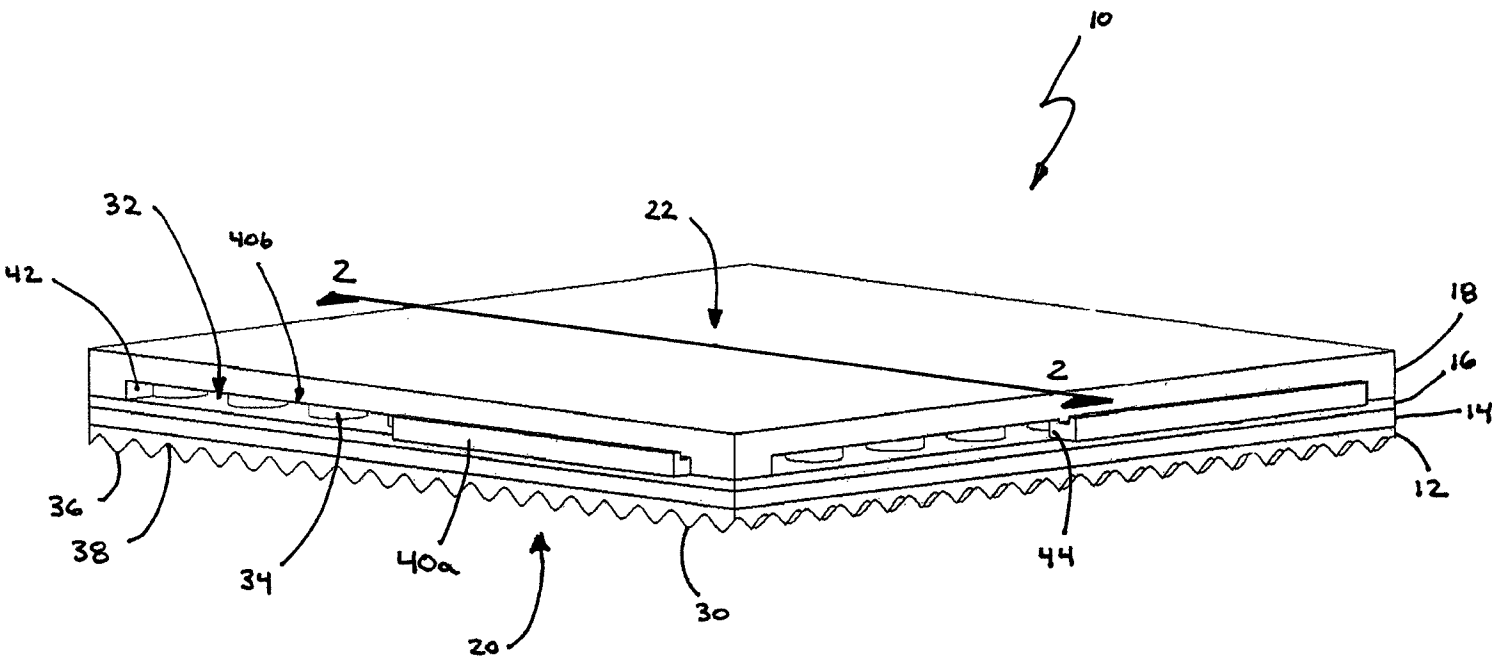
FIG. 1 is an axonometric view of an impact damping mat.
Figure 2:
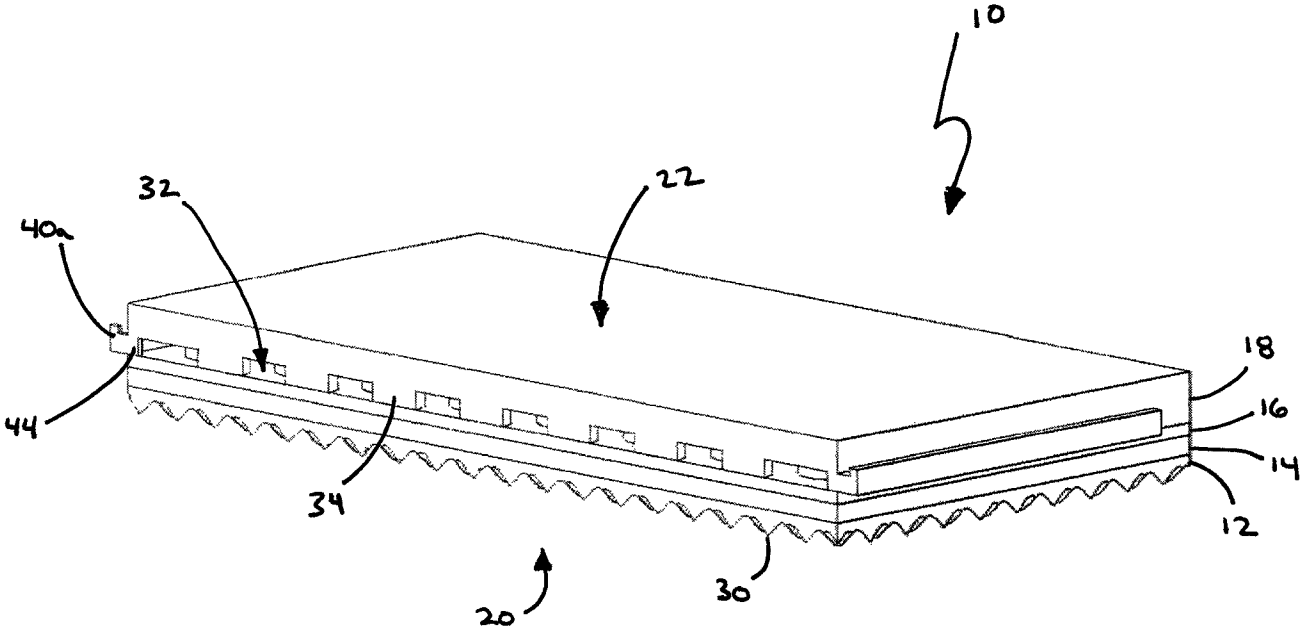
FIG. 2 is a section view of the impact damping mat of FIG. 1 taken through line 2-2.
Figure 3:
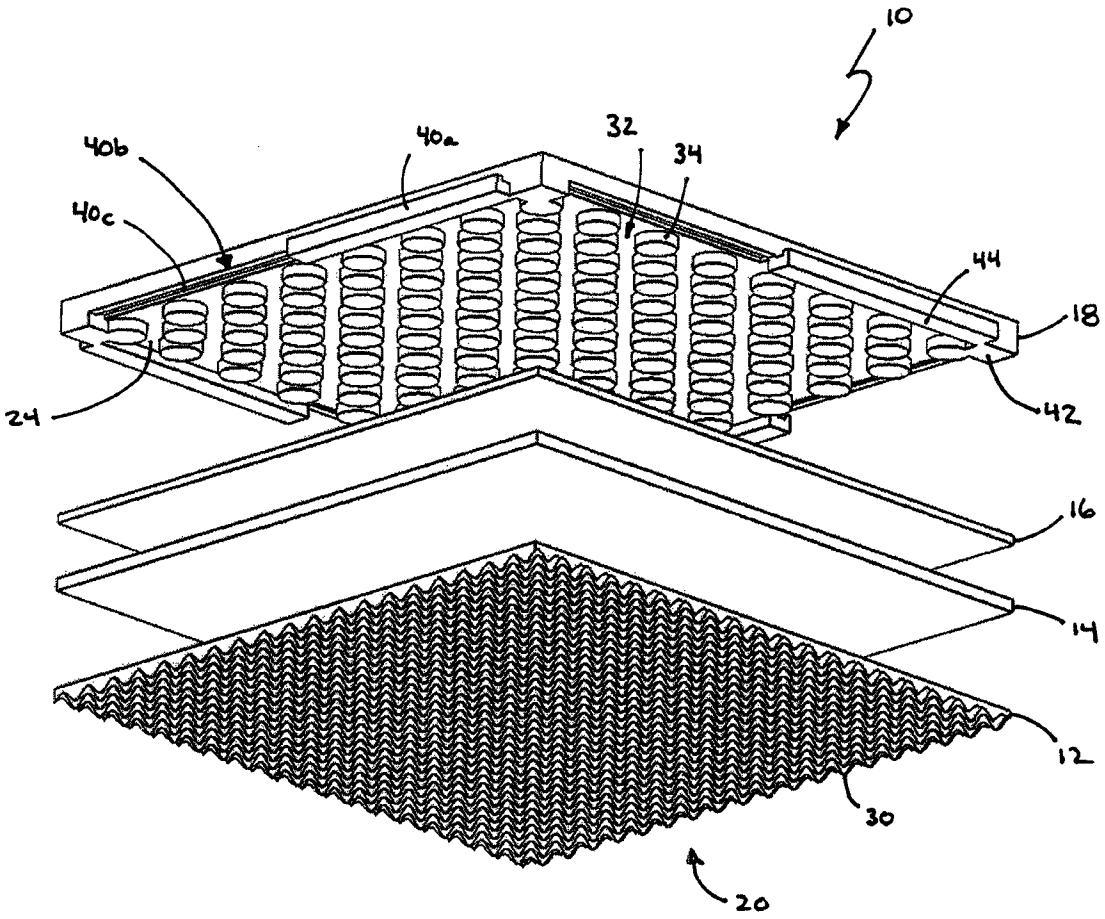
FIG. 3 is an exploded axonometric view of the impact damping mat of FIG. 1, viewed from below.

Turning to FIGS. 1 to 3, an embodiment of an impact damping mat is shown and generally identified by reference character 10. The impact damping mat 10 is intended to be placed on a horizontal surface such as a finished floor, subfloor or underfloor surface.

The impact damping mat 10 is made up of a stack of layers comprising a base layer 12, a damping layer 14, a load distribution layer 16 and an upper layer 18. The materials and dimensions of the base layer 12, the damping layer 14, the load distribution layer 16 and the upper layer 18 cooperate to provide the impact damping mat 10 with a selected rebound characteristic and a selected sound reduction characteristic. All of the layers of the impact damping mat 10 are secured together with an adhesive (not shown), such as a silane polymer-based adhesive.

As can be seen in FIGS. 1 to 3, the base layer 12 has a contoured bottom or base surface 20 with a plurality of protuberances 30, an opposite planar top surface and planar side surfaces. The protuberances 30 on the base surface 20 form an array of peaks 36 and valleys 38. The damping layer 14 overlies the top surface of the base layer 12 and has planar top, bottom and side surfaces. The load distribution layer 16 overlies the top surface of the damping layer 14 and similarly has planar top, bottom and side surfaces. The upper layer 18 overlies the top surface of the load distribution layer 16 and has a planar top surface 22, a recessed undersurface 24 from which a plurality of impact pedestals 34 depend, side walls 44 and corner supports 42. As will be appreciated by a person skilled in the art, planar means a surface that is flat or basically flat. In the case of at least the planar top surface 22, planar may include a textured surface, for example, to improve grip for a person walking on the impact damping mat 10.

The impact pedestals 34 depending from the undersurface 24 are cylindrical and contact the load distribution layer 16 to space the undersurface 24 of the upper layer 18 apart from the load distribution layer 16, thereby defining an interstitial void 32 between the upper layer 18 and the load distribution layer 16.

The upper layer 18 also includes a number of interlocking features to enable the impact damping mat 10 to engage one or more adjacent mats, which may have the same, similar or different properties to the impact damping mat 10. In the embodiment of FIGS. 1 to 3, each side of the upper layer 18 includes a plurality of interlocking features made up of an L-shaped protrusion 40*a* extending outwardly from a side wall 44 of the upper layer 18, a gap 40*b* in the side wall 44 adjacent the protrusion 40*a* and a detent 40*c* in the recessed undersurface 24 adjacent the gap 40*b* and extending the length of the gap 40*b*. Each protrusion 40*a* is adapted to pass through a gap in a side wall of an adjacent mat and engage a detent of that adjacent mat.

In the embodiment of FIGS. 1 to 3, the base layer 12, the load distribution layer 16 and the upper layer 18 are formed of rubber, while the damping layer 14 is formed of a polyether urethane material. More specifically, the base layer 12 is formed of rubber with a thickness of 11/16" (~17 mm) and a weight of 203 lbs per 120 $ft^2$. The damping layer 14 is formed of polyether urethane material with a thickness of ½" (~13 mm) and a weight of 0.76 lbs per 1 $ft^2$ (0.155 kg per 1 $m^2$). The load distribution layer 16 is formed of rubber with a thickness of 5/16" (~8 mm) and a volumetric weight (or density) of approximately 66 lbs/$ft^3$ (1 057 kg/$m^3$). The upper layer 18 is formed of rubber with a thickness of 1¼" (~32 mm) and a weight of 22.7 lbs per 3.9375 $ft^2$.

As discussed above, the materials and dimensions of the base layer 12, the damping layer 14, the load distribution layer 16 and the upper layer 18 cooperate to provide the impact damping mat 10 with a selected rebound characteristic and a selected sound reduction characteristic. As will be understood by a person skilled in the art, altering the materials and/or dimensions of these layers and/or altering the shape of the protuberances 30, the impact pedestals 34 and the interstitial void 32 may alter the rebound and sound reduction characteristics of the impact damping mat 10 and may facilitate with providing the selected rebound and sound reduction characteristics of the impact damping mat 10.

In this embodiment, the selected rebound characteristic of the impact damping mat 10 is a coefficient of restitution no greater than 30% when a 15 lb bowling ball (for example an undrilled TZone® Indigo Swirl, as sold by Brunswick®) is dropped from a height of 1.0 meters above and onto the planar top surface 22, as per ASTM F2117, and the selected sound reduction characteristic of the impact damping mat 10 is a reduction of the maximum sound level ($L_{Fmx}$) of at least 5 dB from 40 Hz to 63 Hz ⅓ octave bands and at least 13 dB at and above 80 Hz ⅓ octave bands normalized to a conventional ⅜" rollout rubber flooring product (for example GenieMat™ FIT08, as sold by Pliteg™) when a 15 lb bowling ball (for example an undrilled TZone® Indigo Swirl, as sold by Brunswick®) is dropped from a height of 1.0 meters above and onto the planar top surface 22.

Each of the layers of the impact damping mat 10 may contribute, at least partially, to providing the selected rebound and sound reduction characteristics. That said, the primary purpose of each of the layers is considered to be as follows: the primary purpose of the base layer 12 is to provide the selected sound reduction characteristic; the primary purpose of the damping layer 14 is to provide the selected rebound reduction characteristic; the primary purpose of the load distribution layer 16 is to distribute repetitive high-impact forces and protect the damping layer 14; and the primary purpose of the upper layer 18 is to provide durability to the impact damping mat 10. A person skilled in the art will understand that the layers of the impact damping mat 10 may help to serve other purposes, including other primary purposes, and the above list should not be read restrictively.

It has been found that the impact pedestals 34 may damage the damping layer 14 when the load distribution layer 16 is not provided. For example, without the load distribution layer 16, the impact pedestals 34 may punch disks out of the damping layer 14 in a cookie-cutter-like fashion as repetitive high-impact forces are applied to the impact damping mat 10 and transmitted through the impact pedestals 34. In embodiments where the damping layer 14 is susceptible to such damage, providing the load distribution layer 16 helps to distribute these repetitive high-impact forces and protect the damping layer 14. It will be appreciated that in embodiments where the damping layer 14 is sufficiently resilient to withstand the repetitive high-impact forces (which may include embodiments where the impact pedestals 34 are omitted or designed to minimize damage to the damping layer 14, for example by rounding the bottoms of the impact pedestals 34), it may be possible to omit the load distribution layer 16.

In use, typically, a plurality of impact damping mats 10 are placed contiguously over a horizontal surface to span an area. As will be appreciated, the size of this area will depend on the intended use of the impact damping mats 10. When placed contiguously, the interlocking features may assist with maintaining the positions of the impact damping mats 10 relative to one another. While this is the typical intended use of the impact damping mat 10, a person skilled in the art will appreciate that alternative embodiments are also possible. For example, in some embodiments a single impact damping mat 10 may be used in isolation, or a plurality of impact damping mats 10 may be placed interspersedly rather than contiguously. In some embodiments, the impact damping mats 10 may be used in conjunction with a particular piece of equipment, as will now be described.

Figure 4:
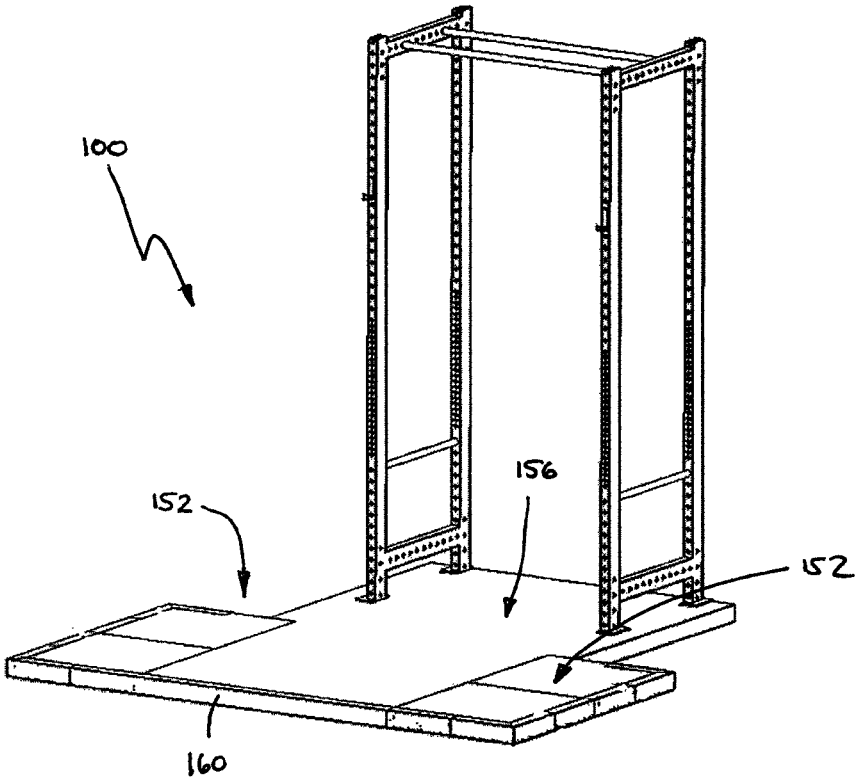
FIG. 4 is an axonometric view of an equipment accessory for use with adjacent equipment.
Figure 5:
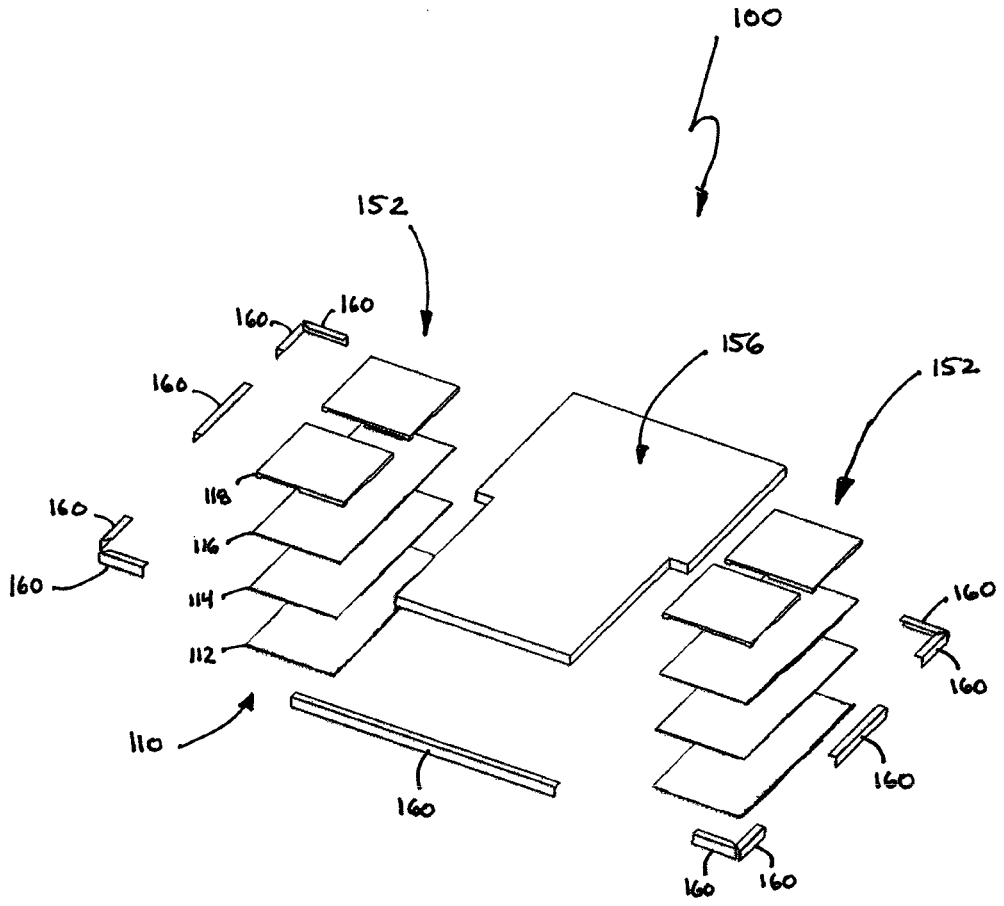
FIG. 5 is an exploded axonometric view of the equipment accessory of FIG. 4, viewed from above with the adjacent equipment omitted.

Turning to FIGS. 4 and 5, an equipment accessory is shown and generally identified by reference character 100. The equipment accessory 100 is intended to be used in conjunction with adjacent equipment such as a raised platform, a weight machine (such as a selectorized machine), weight bench, weight rack, smith machine, a cardio machine (such as a rowing machine, elliptical, treadmill, stationary bicycle or the like) or other fitness equipment. In the present embodiment, the adjacent equipment is a power rack, as shown in FIG. 4.

In this embodiment, the equipment accessory 100 comprises two impact damping zones 152, a less damped zone 156 between the two impact damping zones 152 and a frame 160.

The less damped zone 156 is shaped to be secured to the adjacent equipment, which may help to keep the equipment accessory 100 in proximity to the adjacent equipment during high-impact activities and may facilitate incorporating the equipment accessory 100 in locations with limited floor space.

Each impact damping zone 152 is made up of the same four layers previously described for the impact damping mat 10, which are secured together with the adhesive and provide the same rebound and sound reduction characteristics previously described. However, as can be seen in FIG. 5, in each impact damping zone 152, the bottom three layers (the base layer 112, the damping layer 114 and the load distribution layer 116) are each provided as single elongate and continuous strip or run, while the upper layer 118 is provided as two side-by-side pieces or tiles. Each tile is identical to the upper layer 18 previously described, except insofar as the L-shaped protrusions are omitted from the sides of each tile adjoining the frame 160 and the less damped zone 156. Reference characters previously introduced for the impact damping mat 10 are incremented by 100 to identify the same layers and features for the impact damping zones 152.

The frame 160 surrounds at least part of the two impact damping zones 152 and the less damped zone 156. As can be seen in FIG. 4, in this embodiment, the frame 160 does not completely surround the equipment accessory 100 and so portions of the sides of the less damped zone 156 and the impact damping zones 152 are uncovered. The frame 160 may provide a pleasing appearance for the equipment accessory 100, may help to conceal the various layers of the impact damping zones 152, may help to prevent dust and debris from entering the interstitial voids of the impact damping zones 152 and/or may assist with maintaining the positions of the impact damping zones 152, the less damped zone 156 and/or the adjacent equipment relative to one another. In other embodiments, the frame 160 may surround the entire circumference of the equipment accessory 100 or may be omitted altogether. As described above, the impact damping zones 152 of the equipment accessory 100 provide the same selected rebound characteristic and the same selected sound reduction characteristic as previously described for the impact damping mat 10. While these characteristics may be desirable for reducing the rebound, sound and vibration generated by the high-impact activity for which the equipment accessory 100 is intended to be used, these characteristics may be less desirable for a person standing and performing the high-impact activity. For example, the impact damping zones 152 may be softer and/or less stable than conventional ⅜" rollout rubber flooring product, described above. For at least this reason, the less damped zone 156 provides a different selected rebound characteristic and a different selected sound reduction characteristic from the impact damping zones 152. In the embodiment of FIGS. 4 and 5, the less damped zone 156 is formed of wood and is stiffer than the impact damping zones 152, which may provide increased stability.

Overall, the intent is that a person lifting a weight (such as a barbell with a weight plate on either end from the adjacent power rack) would stand on the less damped zone 156 during lifting and drop their weight on the impact damping zones 152 when done lifting, i.e. a weight plate would land on each impact damping zone 152. Accordingly, the less damped zone 156 is located where a person is likely to stand during lifting and the impact damping zones 152 are located on either side of the less damped zone 156, where the weights are likely to land.

Although it has been previously described that a plurality of discrete impact damping mats 10 may be placed contiguously to cover a large horizontal surface, alternative configurations for covering large horizontal surfaces are also possible, as will now be described.

Figure 6:
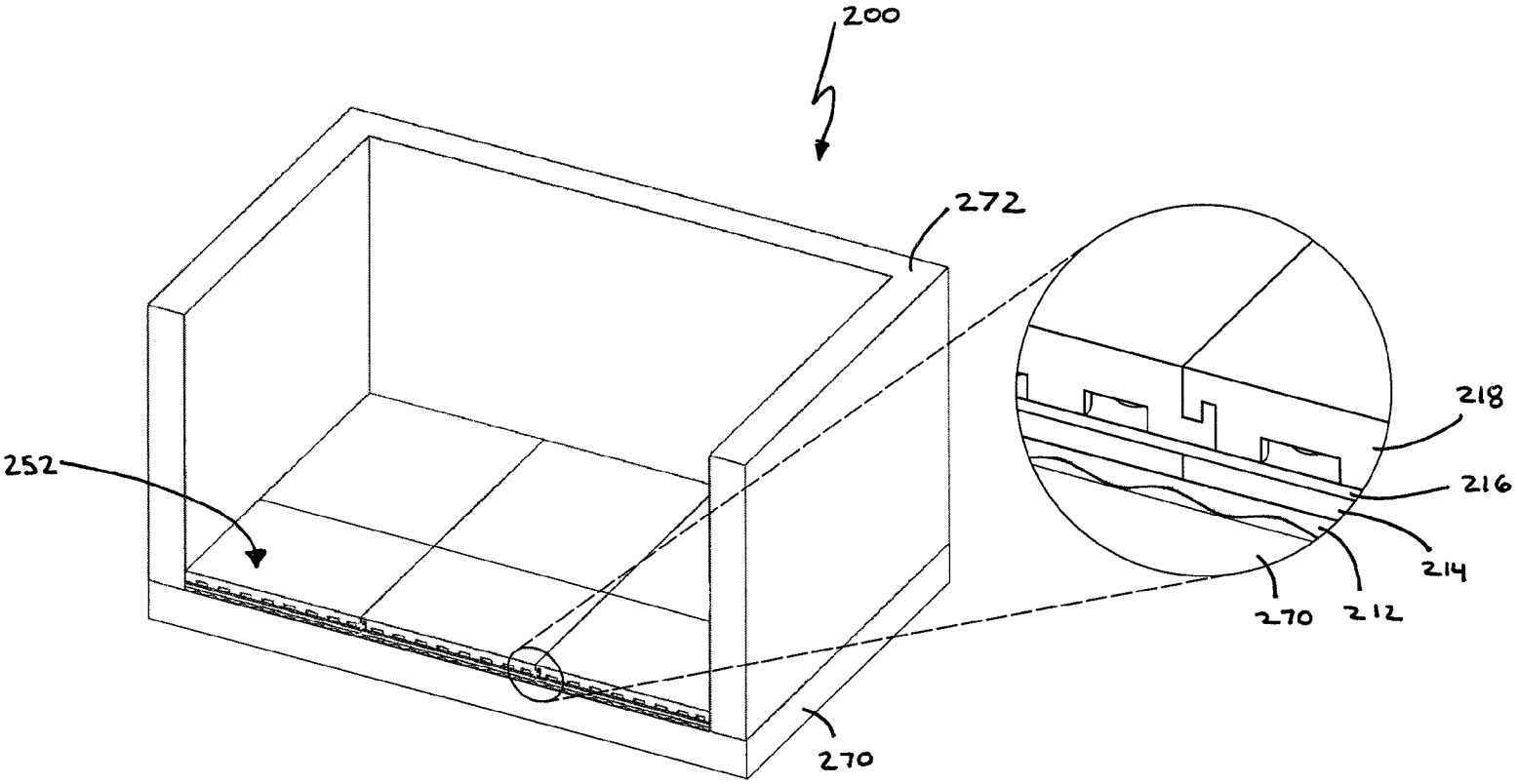
FIG. 6 is a section view of a flooring system, with an enlarged detail of an interface in the flooring system.
Figure 7:
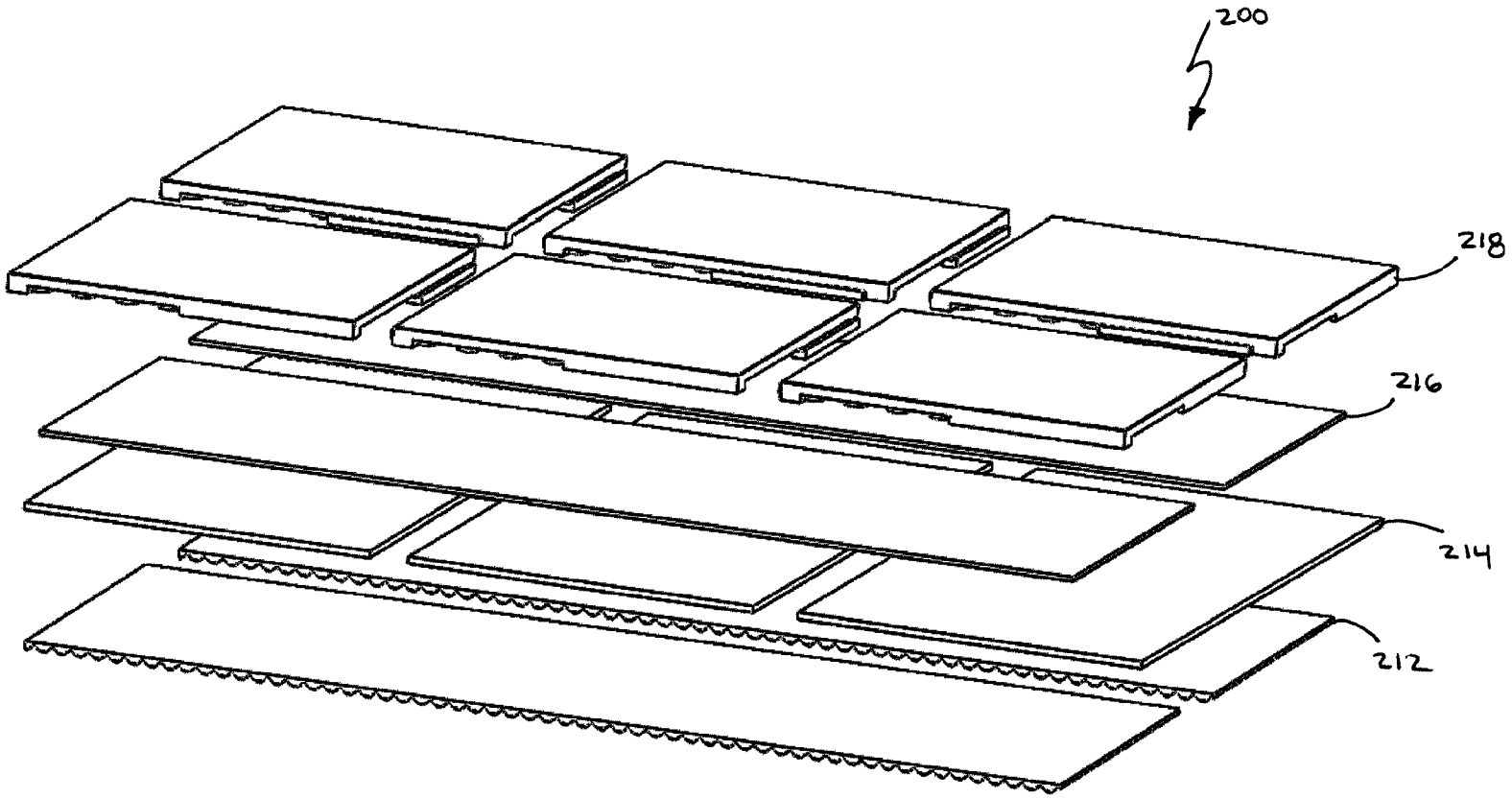
FIG. 7 is an exploded axonometric view of the flooring system of FIG. 6, with the wall and floor omitted.

Turning to FIGS. 6 and 7, an embodiment of a flooring system is shown and generally identified by reference character 200. Similar to the equipment accessory 100, described above, the flooring system 200 comprises an impact damping zone 252. The impact damping zone 252 covers an entire exposed horizontal surface of a floor 270, such as a finished floor, subfloor or underfloor surface and is bounded by a wall 272.

The impact damping zone 252 is made up of the same four layers previously described in the impact damping zone 152, which are secured together with adhesive and provide the same rebound and sound reduction characteristics as previously described. However, each of the layers in the impact damping zone 252 comprises a greater number of runs or tiles, which are placed contiguously to accommodate covering the larger horizontal surface of the floor 270. Additionally, as can be seen in FIG. 7, the runs of alternate layers in the bottom three layers (the base layer 212, the damping layer 214 and the load distribution layer 216) are perpendicular (or nearly perpendicular) to one another to avoid large seams in the flooring system 200, and the L-shaped protrusions on the tiles of the upper layer 218 are only omitted from the sides of the tiles abutting the wall 272. Reference characters previously introduced for the impact damping zones 152 and the impact damping mat 10 are incremented by 100 and 200, respectively, to identify the same layers and features for the impact damping zone 252.

As can be seen in FIG. 7, sides of adjacent tiles in the upper layer 218 comprise the same interlocking features previously described for impact damping mat 10. As will be appreciated, the interlocking features may assist with maintaining the position of the tiles relative to one another in the flooring system 200.

Although the layers 212, 214, 216, 218 of the flooring system 200 have been described as covering the entire exposed horizontal surface of floor 270 in the embodiment of FIGS. 6 and 7, a person skilled in the art will appreciate that in other embodiments these layers 212, 214, 216, 218 may only cover a portion of the horizontal surface or a plurality of discrete portions. The extent of the horizontal surface covered by the layers 212, 214, 216, 218 defines the impact damping zone 252, or zones 252 (when a plurality of discrete portions are covered), of the flooring system 200. Thus, the flooring system 200 may comprise one impact damping zone 252, as shown in the embodiment of FIGS. 6 and 7, or a plurality of discrete impact damping zones 252, in other embodiments.

Additionally, in some embodiments, the flooring system 200 may further comprise at least one or a plurality of less damped zones located adjacent the impact damping zone or zones 252. These less damped zone or zones provide a different selected rebound characteristic and a different selected sound reduction characteristic than the impact damping zone or zones 252, and in some embodiments may be the same as the less damped zone 156, previously described. It will be appreciated that a variety of layouts for the zones of the flooring system 200 are possible. For example, each impact damping zone 252 may be surrounded by a less damped zone, or vice versa. Alternatively, a plurality of less damped zones may be interspersed with a plurality of impact damping zones 252. The layout of the zones will depend on the intended use of the flooring system 200 and the surrounding environment. In this way, the flooring system 200 may provide a variety of characteristics selected to suit the needs of each zone.

In one or more of the embodiments discussed above, the adhesive may be a one-component, 100% solids, cross-linking, modified silane polymer-based adhesive. This adhesive may be solvent-free, water-free, and isocyanate-free, non-flammable, have low-odor, negligible VOC content and contain no hazardous chemicals as per OSHA Regulation CFR 1910.1200. This adhesive may be a Class 1 vapor barrier, feature extremely low-permeability ratings, withstand maximum moisture levels of 10 lbs and 90% RH and may be unaffected by concrete slab alkalinity, have good early strength buildup for immediate grab which gradually builds into a tenacious but resilient bond as the chemicals in the adhesive cross-link. This adhesive may also have plasticizer migration resistance that allows installation of a broad variety of vinyl floor products.

In one or more of the embodiments discussed above, the base layer may be formed of a material with substantially the following properties: at least 80% recycled rubber, sheet weight of 1.9 lbs/ft$^2$ (9.28 kg/m$^2$), tensile strength per ASTM D412 Die C of 35 psi minimum, elongation at break per ASTM D412 Die C of 60% minimum, compressibility per ASTM F36 @ 50 psi=15%/recovery 85% minimum and @ 100 psi=20%/recovery 85% minimum, type A hardness per ASTM D2240 of 30 durometer, and temperature stability between −40° C. to +115° C. (~−40° F. to +240° F.). In some embodiments, the base layer may have a thickness of 11/16" (~17 mm) and a weight of 203 lbs per 120 ft$^2$. In some embodiments, the base layer may have a thickness of 0" to 1" (~0 mm to 25 mm), inclusive; as will be appreciated, in embodiments where the base layer has a thickness of 0" (0 mm), the base layer is omitted.

In one or more of the embodiments discussed above, the damping layer may be formed of a highly damped compound such as a microcellular polyether urethane material with substantially the following properties: rubber deterioration/air oven per ASTM D573 of no deterioration, freeze thaw per ASTM C67 of no deterioration, abrasion resistance per ASTM C501 of 77, slip resistance per ASTM E303 of 63 dry and 72.25 wet, slip resistance per ASTM D2047 of 0.601, elongation at break per ASTM D412 of 35.3% and pass a flammability test per ASTM D2859. In some embodiments, the damping layer may have a thickness of ½" (~13 mm) and a weight of 0.76 lbs per 1 ft$^2$ (0.155 kg per 1 m$^2$). In some embodiments, the damping layer may have a thickness of ¼" to 1½" (~6 mm to 38 mm), inclusive.

In one or more of the embodiments discussed above, the load distribution layer may be formed of a material with substantially the following properties: wear hardness per DIN 53577 of approximately 4.0 MPa, Shore A hardness per DIN 53505 of 60 (+/−5), compression set per DIN 53517 of approximately 15%, abrasion per DIN 53516 of maximum 200 mm$^3$, tensile strength per EN ISO 1798 of approximately 1.5 N/mm$^2$, elongation at break per EN ISO 1798 of approximately 90%, coefficient of friction per EN 13893: 2002 of $\mu$=0.47 (safe), fire resistance per DIN EN 13501-1 of $E_{fl}$ (B2), light fastness per DIN EN 105-B02:1999-09 of 2-3, electrostatic properties per DIN EN 1815:1995-06 of 0.5 kV, remaining deformation per EN 433:1994-11 of 0.13 mm and reduction of impact sound pressure level (ALw) per DIN EN ISO 140-8:1998-03 of 18 dB. In some embodiments, the load distribution layer may have a thickness of 5/16" (~8 mm) and a volumetric weight (or density) of approximately 66 lbs/ft$^3$ (1 057 kg/m$^3$). In some embodiments, the load distribution layer may have a thickness of 3/16" to 7/16" (~5 mm to 11 mm), inclusive.

In one or more of the embodiments discussed above, the upper layer may be formed of a material with substantially the following properties: at least 80% recycled rubber, wear surface density (durability) of greater than 60 lbs/ft$^3$, acoustical IF09-002 per ASTM E2179 of A26 dB, acoustical A09-009 per ASTM EC423/E795 of SAA=0.14 and NRC 0.15, rubber deterioration/air oven per ASTM D573 of no deterioration, freeze thaw per ASTM C67 of no deterioration, slip resistance per ASTM E303 of 102 dry and 62 wet, slip resistance per ASTM D2047 of 0.81 dry and 0.82 wet, tensile strength per ASTM D412 of 107 psi, elongation at break per ASTM D412 of 165%, tear strength per ASTM D624 of 33.1 lbs/in, compression deflection per ASTM D1667 of 29.5 psi to 25% compression, compression set per ASTM D395 of 4.37% permanent set, flammability per ASTM E648 of Class 2, passing a flammability—burning pill test per ASTM D2859 and flammability—roof covering per ASTM E108 of Class A (premium). In some embodiments, the upper layer may have a thickness of 1¼" (~32 mm) and a weight of 22.7 lbs per 3.9375 ft$^2$. In some embodiments, the upper layer may have a thickness of 1" to 1½" (~25 mm to 38 mm), inclusive.

Although the embodiments herein are described as comprising four separate layers, a person skilled in the art will appreciate that in alternative embodiments there may be more or fewer layers which cooperate to provide the selected rebound characteristic and the selected sound reduction characteristic. For example, in some embodiments the load distribution layer may be omitted and the upper layer may be increased in thickness accordingly, to achieve the selected rebound characteristic and the selected sound reduction characteristic. In other embodiments, other layers may be omitted or increased or decreased in thickness.

Although thicknesses and weights of the layers in the embodiments herein have been described with particular measurements, a person skilled in the art will appreciate that these measurements are exemplary and that these measurements may be varied in some embodiments depending on the high-impact activity for which the embodiment is intended to be used.

Although the base layer, the load distribution layer and the upper layer in the embodiments herein have been described as being made of rubber or at least 80% recycled rubber, a person skilled in the art will appreciate that in some embodiments some or all of these layers may be formed of polyurethane, poly-ether urethane, natural rubber, styrene-butadiene rubber (SBR), at least 90% recycled rubber, fabric and/or polycarbonate.

Although the damping layer in the embodiments herein has been described as being made of a polyether urethane material, a person skilled in the art will appreciate that in some embodiments the damping layer may be formed of polyurethane, poly-ether urethane, natural rubber, SBR, fabric and/or polycarbonate.

Although the layers of the embodiments herein have been described as being secured together with a silane polymer-based adhesive, a person skilled in the art will appreciate that in some embodiments other adhesives or mechanisms for securing the layers together may be used. For example, in some embodiments such other adhesives may include hot adhesives and/or adhesives that are contact based, pressure sensitive based, 1-part and/or multi-part based, solvent based and/or polymer dispersion based, and such other mechanisms may include mechanical adhesion. In some embodiments, a plurality of the layers or none of the layers may be secured together with an adhesive. For example, none of the layers may be secured together in embodiments where the weight of the layers and/or the environment surrounding the layers are sufficient to hold the layers in place during the high-impact activities for which the embodiment is intended to be used.

Although the base layer, the damping layer, the load distribution layer and the upper layer have been described in the embodiments herein as cooperating to provide the impact damping mat and impact damping zones with the selected rebound characteristic and the selected sound reduction characteristic, a person skilled in the art will appreciate that in some embodiments more or fewer layers may cooperate to provide the selected rebound characteristic and the selected sound reduction characteristic. For example, in embodiments where the impact damping mat or impact damping zones comprise additional layers, all of the layers may cooperate to provide the selected rebound characteristic and the selected sound reduction characteristic. Conversely, in embodiments where the impact damping mat or impact damping zones comprise fewer layers (for example, where the load distribution layer is omitted) the remaining layers may cooperate to provide the selected rebound characteristic and the selected sound reduction characteristic. A person skilled in the art will appreciate that all of the layers and features of an embodiment may contribute at least partially to the rebound and sound reduction characteristics. Consequently, what layers and features provide the selected rebound characteristic and the selected sound reduction characteristics should not be read restrictively.

Although the coefficient of restitution in the embodiments described herein is selected to be no greater than 30% when a 15 lb bowling ball (for example an undrilled TZone® Indigo Swirl, as sold by Brunswick®) is dropped from a height of 1.0 meters above and onto the planar top surface as per ASTM F2117, a person skilled in the art will appreciate that this selected coefficient of restitution is for exemplary purposes only and that the selected coefficient of restitution may be varied in some embodiments depending on the high-impact activity for which the embodiment is intended to be used. A person skilled in the art will also appreciate that the coefficient of restitution may be measured with a mass other than a 15 lb bowling ball in some embodiments, which may vary the measurement.

Although the reduction of maximum sound level in the embodiments described herein is selected to be at least 5 dB from 40 Hz to 63 Hz ⅓ octave bands and at least 13 dB at and above 80 Hz ⅓ octave bands normalized to a conventional ⅜" rollout rubber flooring product (for example GenieMat™ FIT08, as sold by Pliteg™) when a 15 lb bowling ball (for example an undrilled TZone® Indigo Swirl, as sold by Brunswick®) is dropped from a height of 1.0 meters above and onto the planar top surface, a person skilled in the art will appreciate that this selected reduction of maximum sound level is for exemplary purposes only and the selected reduction of maximum sound level may be varied in some embodiments depending on the high-impact activity for which the embodiment is intended to be used. A person skilled in the art will also appreciate that the reduction of maximum sound level may be measured over other frequency ranges or with a mass other than a 15 lb bowling ball in some embodiments, which may vary the measurement.

Although the selected rebound characteristic and the selected sound reduction characteristic in the embodiments described herein are a coefficient of restitution and a reduction of maximum sound level, a person skilled in the art will appreciate that other characteristics may be selected in some embodiments. A person skilled in the art will appreciate that the selected rebound characteristic and the selected sound reduction characteristic will depend on the intended use of the impact damping mat, equipment accessory or flooring system. In embodiments where the objects involved in the high-impact activity are more likely to cause injury to nearby persons or damage nearby structure or equipment, the selected rebound characteristic may be a value that results in less rebound. Conversely, in embodiments where the objects involved in the high-impact activity are less likely to cause injury or damage, the selected rebound characteristic may be a value that results in more rebound. Similarly, in embodiments where sounds are more likely to negatively affect nearby persons, the selected sound reduction characteristic may be a value that results in less noise. Conversely, in embodiments where sounds are less likely to negatively affect nearby persons, the selected sound reduction characteristic may be a value that results in more noise.

Although the impact pedestals have been described as spacing the undersurface apart from the load distribution layer thereby defining a single interconnected interstitial void in the embodiments described herein, a person skilled in the art will appreciate that in some other embodiments these features may define a plurality of interstitial voids between the upper layer and the load distribution layer.

Although the impact pedestals are shown and described as cylindrical, a person skilled in the art will appreciate that in some embodiments the impact pedestals may be other shapes or configurations, for example, in some embodiments the impact pedestals may be conoid, polyhedronal, spherical caps, spherical segments, ellipsoidal caps, ellipsoidal segments and/or sinusoidal shaped. In some embodiments the impact pedestals may be hollow. In some embodiments the impact pedestals may be omitted and the undersurface of the upper layer may not be recessed and may be planar, similar to the bottom surfaces of damping layer and the load distribution layer as previously described. In such embodiments, the load distribution layer may be omitted from the impact damping mat.

Although the protuberances are shown and described as being shaped to define a sinusoidal array of peaks and valleys, a person skilled in the art will appreciate that in some embodiments the protuberances may be other shapes or configurations, for example, in some embodiments the protuberances may be conoid, cylindrical, polyhedronal, spherical caps, spherical segments, ellipsoidal caps and/or ellipsoidal segments. In some embodiments the protuberances may be hollow.

Although the interlocking features in the embodiments herein have been shown and described as comprising L-shaped protrusions, gaps and detents wherein each protrusion is adapted to pass through a gap in the side wall of an adjacent mat and engage a detent of that adjacent mat, a person skilled in the art will appreciate that in some embodiments the interlocking features may be adapted to engage other objects such as adjacent equipment, adjacent flooring and/or an adjacent structure. Further, a person skilled in the art will appreciate that in some embodiments the interlocking features may protrude from another layer or from a plurality of layers. For example, an interlocking feature may comprise a first portion extending from the upper layer and a second portion extending from the base layer which cooperate to engage an adjacent object. In some embodiments, the interlocking features may comprise one or a plurality of channel-shapes, crenulations, tabs, slots, protrusions, cut-outs, intrusions, indentations, detents and/or perforations. In some embodiments, the interlocking features may not be wholly located at the periphery of the impact damping mat or a tile thereof. For example, in some embodiments an interlocking feature may comprise a threaded rod which is secured at the periphery of the impact damping mat or tile and extends through the impact damping mat or tile.

Although the less damped zones in the embodiments herein have been described above as being stiffer than the impact damping zones, a person skilled in the art will appreciate that in some embodiments the less damped zone may provide other properties complimentary to their intended use. As will also be appreciated, in embodiments with a plurality of less damped zones, the less damped zones may provide the same or different properties from one another. For example, one or more of the less damped zones may provide increased stability to accommodate weight lifting, while one or more other less damped zones may be softer to accommodate stretching or other activities. Similarly, in embodiments with a plurality of impact damping zones, the impact damping zones may provide the same or different selected rebound characteristics and the same or different selected sound reduction characteristics from each other.

Although the less damped zone has been described above as being formed of wood, a person skilled in the art will appreciate that in other embodiments each less damped zone may be formed of other suitable materials such as polyurethane, poly-ether urethane, natural rubber, SBR, fabric, polycarbonate, plywood, gypsum concrete, lightweight concrete, normal weight concrete, oriented strand board, luon, cement board, paper board, gypsum board, particle board, plastic and/or metal.

Although the bottom three layers (the base layer, the damping layer and the load distribution layer) of the equipment accessory and the flooring system have each been described as being in the form of elongate and continuous strips or runs, a person skilled in the art will appreciate that each of these layers may take the form of a plurality of discrete side-by-side tiles, similar to the upper layer previously described. Likewise, while the upper layer has been described as being provided as a plurality of discrete side-by-side tiles, this layer may take the form of one or more elongate and continuous strips or runs, similar to the aforementioned bottom three layers.

Where a plurality of adjacent layers are provided in the form of tiles, one or more tiles from each of these layers may be secured together to form a pre-assembled multi-layer tile. Providing a plurality of layers as tiles and/or pre-assembled multi-layer tiles may facilitate installation, shipment and/or storage of these layers. It may be particularly desirable to provide a layer as a plurality of tiles where that layer is too stiff to be provided as runs that can be rolled up for shipment and/or storage.

Although the equipment accessory has been described above as comprising two impact damping zones and one less damped zone, a person skilled in the art will appreciate that in some embodiments the equipment accessory may comprise one impact damping zone or more than two impact damping zones. Similarly, in some embodiments the equipment accessory may comprise a plurality of less damped zones. As will be appreciated, the composition of the equipment accessory may vary depending on the high-impact activity and the adjacent equipment with which the equipment accessory is intended to be used. In some embodiments the adjacent equipment may not be fitness equipment and may be some other equipment associated with a high-impact activity which may take place in a mechanical room, health-care facility, studio, school or the like.

Although the less damped zone has been described as being shaped to be secured to the adjacent equipment, in some embodiments, at least one or a plurality of the less damped zone, the frame and the impact damping zones may be shaped to be secured to the adjacent equipment. In some embodiments, at least one or a plurality of the frame, the less damped zone and the impact damping zones may comprise a fastening mechanism to secure the equipment accessory to the adjacent equipment. A person skilled in the art will appreciate that the equipment accessory, and the elements thereof, may be adapted to be secured to the adjacent equipment in a variety of ways depending on the adjacent equipment with which the equipment accessory is intended to be used. For example, in some embodiments the less damped zone of the equipment accessory may be shaped to pass between parts of the adjacent equipment and thereby be secured to the adjacent equipment.

Although the interlocking features have been described as omitting the L-shaped protrusion on the sides of the impact damping zones adjacent the frame and the less damped zone in the equipment accessory, a person skilled in the art will appreciate that the interlocking features may vary depending on the composition of the equipment accessory and the adjacent equipment with which the equipment accessory is intended to be used. In some embodiments, the interlocking features may be omitted or different than previously described on various sides of the impact damping zones, for example, in some embodiments the interlocking features on the sides of the impact damping zones adjacent the less damped zone may be adapted to engage the less damped zone, to assist with maintaining the position of the impact damping zones relative to the less damped zone.

Although the horizontal surface in the embodiments herein has been described as a finished floor, subfloor or underfloor surface, a person skilled in the art will appreciate that the impact damping mat, equipment accessory and flooring system described herein are adaptable and can overlie a variety of surfaces in a variety of embodiments. These surfaces may comprise a concrete slab or other materials, for example, plywood, gypsum concrete, light-weight concrete, normal weight concrete, oriented strand board, luon, cement board, paper board, gypsum board and/or particle board.

Although the embodiments of the impact damping mat, equipment accessory and flooring system have been described individually and separately, above, a person skilled in the art will appreciate that these embodiments are intentionally adaptable and should not be read as necessarily distinct. For example, in some embodiments a plurality of the impact damping mats may be placed contiguously to cover all or part of a horizontal surface such that the impact damping mats form a defacto flooring system. Similarly, in some embodiments, the flooring system may only cover a portion of a horizontal surface such that it forms a defacto impact damping mat and/or equipment accessory.

The impact damping mat, equipment accessory and/or flooring system described herein may be used in many environments. For example, the impact damping mat, equipment accessory and/or flooring system can be used to retrofit existing buildings or may be installed in a newly constructed building to mitigate rebound and noise generated from high-impact activities.

Embodiments of the impact damping mat, equipment accessory and flooring system have been described above, and with reference to the drawings for the impact damping mat and equipment accessory. Those of skill in the art will however appreciate that variations and modifications can be made without departing from the scope thereof as defined by the appended claims.

What is claimed is:

1. An impact damping mat comprising:

a base layer having a base surface with a plurality of protuberances;

a damping layer overlying the base layer;

a load distribution layer overlying the damping layer; and an upper layer overlying the load distribution layer and having a planar top surface, wherein the materials and dimensions of the base layer, the damping layer, the load distribution layer and the upper layer cooperate to provide a selected rebound characteristic and a selected sound reduction characteristic, wherein the upper layer has a recessed undersurface from which a plurality of impact pedestals depend, and wherein the impact pedestals contact the load distribution layer and space the undersurface from the load distribution layer, defining an interstitial void between the upper layer and the load distribution layer.

2. The impact damping mat of claim 1, wherein the selected rebound characteristic is a coefficient of restitution no greater than 30% and the selected sound reduction characteristic is a reduction of a maximum sound level of at least 5 dB from 40 to 63 Hz ⅓ octave bands and at least 13 dB at and above 80 Hz ⅓ octave bands normalized to a conventional ⅜ inch rollout rubber flooring product.

3. The impact damping mat of claim 1, wherein the base layer is formed of rubber and has a thickness no greater than 1 inch.

4. The impact damping mat of claim 3, wherein the thickness of the base layer is 11/16 of an inch.

5. The impact damping mat of claim 1, wherein the damping layer is formed of a polyether urethane material and has a thickness of ¼ of an inch to 1½ inches, inclusive.

6. The impact damping mat of claim 5, wherein the thickness of the damping layer is ½ of an inch.

7. The impact damping mat of claim 1, wherein the load distribution layer is formed of rubber and has a thickness of 3/16 of an inch to 7/16 of an inch, inclusive.

8. The impact damping mat of claim 7, wherein the thickness of the load distribution layer is 5/16 of an inch.

9. The impact damping mat of claim 1, wherein the upper layer is formed of rubber and has a thickness of 1 inch to 1½ inches, inclusive.

10. The impact damping mat of claim 9, wherein the thickness of the upper layer is 1¼ inches.

11. The impact damping mat of claim 1, further comprising at least one interlocking feature adapted to engage an adjacent mat.

12. A flooring system comprising a plurality of the impact damping mats of claim 1, wherein the impact damping mats are placed contiguously to overlie a horizontal surface.

13. An equipment accessory comprising:

at least one impact damping zone, each impact damping zone including:

a base layer having a base surface with a plurality of protuberances, a damping layer overlying the base layer, a load distribution layer overlying the damping layer, and an upper layer overlying the load distribution layer and having a planar top surface, wherein the materials and dimensions of the base layer, the damping layer, the load distribution layer and the upper layer cooperate to provide a selected rebound characteristic and a selected sound reduction characteristic, wherein the upper layer has a recessed undersurface from which a plurality of impact pedestals depend, and wherein the impact pedestals contact the load distribution layer and space the undersurface from the load distribution layer, defining an interstitial void between the upper layer and the load distribution layer; and at least one less damped zone adjacent to at least one of the impact damping zones, each less damped zone providing a different selected rebound characteristic and a different selected sound reduction characteristic than the adjacent impact damping zones.

14. The equipment accessory of claim 13, wherein for at least one of the impact damping zones the selected rebound characteristic is a coefficient of restitution no greater than 30% and the selected sound reduction characteristic is a reduction of a maximum sound level of at least 5 dB from 40 to 63 Hz ⅓ octave bands and at least 13 dB at and above 80 Hz ⅓ octave bands normalized to a conventional ⅜ inch rollout rubber flooring product.

15. A flooring system comprising:

at least one impact damping zone, each impact damping zone including:

a base layer having a base surface with a plurality of protuberances, a damping layer overlying the base layer, a load distribution layer overlying the damping layer, and an upper layer overlying the load distribution layer and having a planar top surface, wherein the materials and dimensions of the base layer, the damping layer, the load distribution layer and the upper layer cooperate to provide a selected rebound characteristic and a selected sound reduction characteristic, wherein the upper layer has a recessed undersurface from which a plurality of impact pedestals depend, and wherein the impact pedestals contact the load distribution layer and space the undersurface from the load distribution layer, defining an interstitial void between the upper layer and the load distribution layer.

16. The flooring system of claim 15, wherein for at least one of the impact damping zones the selected rebound characteristic is a coefficient of restitution no greater than 30% and the selected sound reduction characteristic is a reduction of a maximum sound level of at least 5 dB from 40 to 63 Hz ⅓ octave bands and at least 13 dB at and above 80 Hz ⅓ octave bands normalized to a conventional ⅜ inch rollout rubber flooring product.

17. An equipment accessory comprising:

two impact damping zones, each impact damping zone comprising:

a base layer having a base surface with a plurality of protuberances, the base layer being formed of rubber and having a thickness of 11/16 of an inch, a damping layer overlying the base layer, the damping layer being formed of a polyether urethane material and having a thickness of ½ of an inch, a load distribution layer overlying the damping layer, the load distribution layer being formed of rubber and having a thickness of 5/16 of an inch, and an upper layer overlying the load distribution layer and having a planar top surface, the upper layer being formed of rubber, having a thickness of 1¼ inches and comprising a recessed undersurface from which a plurality of impact pedestals depend, wherein the impact pedestals contact the load distribution layer and space the undersurface from the load distribution layer, defining an interstitial void between the upper layer and the load distribution layer, wherein all of the layers are secured together with an adhesive, and wherein the base layer, the damping layer, the load distribution layer and the upper layer cooperate to provide a coefficient of restitution no greater than 30% and a reduction of a maximum sound level of at least 5 dB from 40 to 63 Hz ⅓ octave bands and at least 13 dB at and above 80 Hz ⅓ octave bands normalized to a conventional ⅜ inch rollout rubber flooring product;

a less damped zone located adjacent and between the two impact damping zones, the less damped zone providing a different coefficient of restitution and a different reduction of the maximum sound level than each of the impact damping zones; and a frame at least partially surrounding the two impact damping zones and the less damped zone.

18. A flooring system comprising:

a base layer having a base surface with a plurality of protuberances, the base layer being formed of rubber and having a thickness of 11/16 of an inch, the base layer comprising a plurality of elongate base layer runs placed contiguously in a first direction;

a damping layer overlying the base layer, the damping layer being formed of a polyether urethane material and having a thickness of ½ of an inch, the damping layer comprising a plurality of elongate damping layer runs placed contiguously in a second direction perpendicular to the first direction;

a load distribution layer overlying the damping layer, the load distribution layer being formed of rubber and having a thickness of 5/16 of an inch, the load distribution layer comprising a plurality of elongate load distribution layer runs placed contiguously in the first direction; and an upper layer overlying the load distribution layer and having a planar top surface, the upper layer being formed of rubber and having a thickness of 1¼ inches, the upper layer comprising a plurality of side-by-side tiles, each of the tiles comprising a recessed undersurface from which a plurality of impact pedestals depend;

wherein, for each of the tiles, the impact pedestals contact the load distribution layer and space the undersurface from the load distribution layer, defining an interstitial void between the upper layer and the load distribution layer;

wherein all of the layers are secured together with an adhesive;

wherein the base layer, the damping layer, the load distribution layer and the upper layer cooperate to provide a coefficient of restitution no greater than 30% and a reduction of a maximum sound level of at least 5 dB from 40 to 63 Hz ⅓ octave bands and at least 13 dB at and above 80 Hz ⅓ octave bands normalized to a conventional ⅜ inch rollout rubber flooring product; and wherein each of the tiles comprises at least one interlocking feature to engage at least one adjacent tile in the plurality of side-by-side tiles.

19. An impact damping mat comprising:

a plurality of layers arranged in a stacked formation, one of said layers having a recessed undersurface from which a plurality of impact pedestals depend, the impact pedestals contacting an underlying layer in the stacked formation and spacing the undersurface of the one layer from the underlying layer thereby to define an interstitial void between the one layer and the underlying layer;

wherein the one layer is an upper layer of said stacked formation, and wherein the one layer has a planar upper surface;

wherein the underlying layer is a load distribution layer;

wherein the impact damping mat further comprises a base layer beneath said load distribution layer, the base layer having a contoured base surface and an array of protuberances depending therefrom.

20. The impact damping mat of claim 19, further comprising a damping layer interposed between said base layer and load distribution layer.

21. The impact damping mat of claim 20, wherein the base layer is formed of rubber.

22. The impact damping mat of claim 21, wherein the damping layer is formed of a polyether urethane material.

23. The impact damping mat of claim 22, wherein the load distribution layer and upper layer are formed of rubber.

24. The impact damping mat of claim 23, wherein the load distribution layer has a thickness in the range of 3/16 of an inch to 7/16, wherein the upper layer has a thickness in the range of 1 inch to 1½ inches, and wherein the damping has a thickness in the range of ¼ of an inch to 1½ inches.

25. The impact damping mat of claim 24, wherein the impact damping mat has a coefficient of restitution no greater than 30% and a reduction of a maximum sound level of at least 5 dB from 40 to 63 Hz ⅓ octave bands and at least 13 dB at and above 80 Hz ⅓ octave bands.

26. The impact damping mat of claim 19, further comprising at least one interlocking feature adapted to engage an adjacent impact damping mat.

27. The impact damping mat of claim 26, wherein the impact damping mat is generally square, and comprises at least one interlocking feature at each side thereof to engage adjacent impact damping mats.

28. A flooring system comprising a plurality of the impact damping mats of claim 27, wherein the impact damping mats are placed contiguously to overlie a horizontal surface.

29. The impact damping mat of claim 19, wherein the impact damping mat has a coefficient of restitution no greater than 30% and a reduction of a maximum sound level of at least 5 dB from 40 to 63 Hz ⅓ octave bands and at least 13 dB at and above 80 Hz ⅓ octave bands.

30. The impact damping mat of claim 19, further comprising a damping layer interposed between said base layer and load distribution layer.

* * * * *